US008082988B2

(12) United States Patent
Redlinger et al.

(10) Patent No.: US 8,082,988 B2
(45) Date of Patent: Dec. 27, 2011

(54) APPARATUS AND METHOD FOR STABILIZATION OF DOWNHOLE TOOLS

(75) Inventors: Thomas M. Redlinger, Houston, TX (US); Christopher M. Vreeland, Houston, TX (US); Jerry W. Fisher, Tomball, TX (US); Thurman B. Carter, Spring, TX (US); Thomas F. Bailey, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 280 days.

(21) Appl. No.: 12/014,338

(22) Filed: Jan. 15, 2008

(65) Prior Publication Data

US 2008/0169107 A1 Jul. 17, 2008

Related U.S. Application Data

(60) Provisional application No. 60/885,159, filed on Jan. 16, 2007.

(51) Int. Cl.
*E21B 17/10* (2006.01)

(52) U.S. Cl. ..... 166/241.6; 166/382; 175/325.3; 175/76

(58) Field of Classification Search ..... 166/381, 166/382, 212; 175/352, 325.2, 325.3, 323, 175/76

See application file for complete search history.

(56) References Cited

U.S. PATENT DOCUMENTS

| | | | | |
|---|---|---|---|---|
| 3,907,048 | A | 9/1975 | Gray | |
| 5,168,941 | A * | 12/1992 | Krueger et al. | 175/26 |
| 5,560,439 | A | 10/1996 | Delwiche et al. | |
| 5,649,603 | A * | 7/1997 | Simpson et al. | 175/323 |
| 6,457,532 | B1 | 10/2002 | Simpson | |
| 2005/0241858 | A1 * | 11/2005 | Eppink et al. | 175/325.1 |

FOREIGN PATENT DOCUMENTS

| | | |
|---|---|---|
| RU | 2 165 002 | 10/2001 |
| WO | WO 02/018739 | 7/2002 |

OTHER PUBLICATIONS

GB Search Report, Application No. GB0800759.3, dated Mar. 17, 2008.
Canadian Office Action for Application No. 2,618,311 dated Apr. 6, 2010.
Canadian Office Action for Application No. 2,618,311 dated Jan. 20, 2011.
GB Examination Report for Application No. GB0800759.3 dated Oct. 4, 2010.

* cited by examiner

*Primary Examiner* — William P Neuder
*Assistant Examiner* — Yong-Suk Ro
(74) *Attorney, Agent, or Firm* — Patterson & Sheridan, LLP

(57) ABSTRACT

A method and apparatus for stabilizing a downhole tool during a downhole operation. The method and apparatus include a stabilizer having a stabilization member adapted to move between a retracted position and an extended position in order to engage a surface in a wellbore. The stabilizer also includes a plurality of actuators adapted to move the stabilization members from the retracted position to the extended position.

36 Claims, 12 Drawing Sheets

APPARATUS AND METHOD FOR STABILIZATION OF DOWNHOLE TOOLS

CROSS-REFERENCE TO RELATED APPLICATIONS

This application claims benefit of U.S. provisional patent application Ser. No. 60/885,159, filed Jan. 16, 2007, which is herein incorporated by reference in its entirety.

BACKGROUND OF THE INVENTION

1. Field of the Invention

Embodiments described herein generally relate to methods and apparatus for stabilizing a downhole tool during a downhole operation. Particularly, the embodiments relate to an expandable stabilizer adapted to contact the interior of a tubular in a wellbore during a downhole operation. More particularly, the embodiments relate to a fluid actuated stabilizer that is offset from a radius of a body of the stabilizer in order to improve stabilization while increasing the life of the stabilizer and downhole tool.

2. Description of the Related Art

During the drilling and production of oil and gas wells, a wellbore is formed in the earth and typically lined with a tubular that is cemented into place to prevent cave ins and to facilitate isolation of certain areas of the wellbore for collection of hydrocarbons. During drilling and production, a number of items may become stuck in the wellbore. Those items may be cemented in place in the wellbore and/or lodged in the wellbore. Such stuck items may prevent further operations in the wellbore both below and above the location of the item. Those items may include drill pipe, packers, and downhole tools. In order to remove the item, milling tools are used to cut or drill the item from the wellbore.

Typical milling tools have blades located on the lower end of the milling tool. The blades form a cutting surface. As the milling tool is rotated, the cutting surface will cut through the stuck item. The cutting of the stuck item will wear away the cutting surface and eventually require the replacement of the milling tool. The time required to remove and replace the milling tool amounts to a substantial cost due to lost rig time and the equipment costs. Therefore, extending the life of the milling tool greatly increases the cost effectiveness of the milling operation.

A number of factors contribute to the milling tool wear, including blade material, blade configuration, and vibration of the milling tool. Vibration of the milling tool is caused by the milling tool and the milling tool conveyance being of a smaller diameter than a wellbore tubular in which the milling operation is taking place. The smaller diameter of the milling tool creates a clearance area between the tubular and the tool allowing movement of the tool in the tubular. Further, the milling tools are often built significantly smaller than the tubular in order to ensure that the milling tool will pass any restrictions downhole. In addition, often times the tubular that is deeper in the wellbore has a smaller wall thickness than the tubular near the surface of the wellbore. The smaller wall thickness causes the wellbore inner diameter to be larger at the bottom than near the surface. This creates an even larger clearance area between the milling tool and the tubular. When the milling tool is rotated to mill the stuck item, the milling tool and the conveyance move and vibrate rapidly in the clearance area. This vibration greatly reduces the life of the milling tool and decreases the rate the milling tool cuts the stuck item.

Currently, in order to minimize vibration during milling, stabilizers are used in conjunction with the milling tool. Traditional stabilizers were fixed members coupled to the milling tool. The traditional stabilizers have fixed length protrusions extending radially from the stabilizer. These protrusions have an outer diameter of close to the minimum inner diameter of the tubular they were run into. The traditional stabilizers must be small enough to travel within the tubular and therefore always have some degree of clearance between the stabilizer and the inner diameter of the tubular. Though traditional stabilizers are robust, they do little to hamper vibration.

Further, bow spring stabilizers are used to stabilize a milling tool. The bow spring stabilizer is simply a plurality of thin metal sheets located circumferentially around the stabilizer. Once downhole, the bow springs are actuated to bow radially outward and into contact with the internal diameter of the tubular. The bow spring stabilizers are not effective at reducing the vibration in the milling tool. This is due to the bow spring being flexible and allowing vibration to transfer through the bow spring and to the milling tool during a milling operation. Further, the bow spring lacks robustness and is often subject to mechanical failure when debris or restrictions are encountered.

There is a need for a method and apparatus to reduce the vibration of a milling tool thereby increasing the longevity and the effectiveness of the milling tool. There is also a need for an expandable stabilizer that may engage an inner diameter of a downhole tubular during a milling operation. There is a further need for a stabilizer that is compliant in order to take up inner diameter tolerance and/or variation of the wellbore during a downhole operation.

SUMMARY OF THE INVENTION

A method of stabilizing a downhole tool in a wellbore during a downhole operation is described herein. The method may include coupling a stabilizing tool to the downhole tool, the stabilizing tool having a plurality of stabilizer members and running the downhole tool and the stabilizing tool into the wellbore. The method may further include extending the plurality of stabilization members into engagement with a surface in the wellbore.

An apparatus for stabilizing a downhole operation in a wellbore is described herein. The apparatus may include a tubular body and a stabilizing member operatively coupled to the tubular body and configured to engage a surface in the wellbore. The apparatus may further include a piston and cylinder assembly at least partially contained within the tubular body and configured to move the stabilizing member between a retracted position and an extended position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of apparatus and methods for stabilizing a downhole tool during a downhole operation in a wellbore are provided. In one embodiment, the downhole tool is a milling tool for use with a milling operation; however, it should be appreciated that the downhole tool may be any tool including but not limited to a drilling tool, a drill bit, a broaching tool, and a flexible broach. In one embodiment, an expandable stabilizer is operatively coupled to the downhole tool and a conveyance and lowered into a wellbore. The downhole tool is lowered until it reaches a location where a downhole operation is to be performed. For example, the location may be a location where an item is stuck in the wellbore. Because the stabilizer is expandable, it may be run into the wellbore in a retracted position. This allows the stabilizer to easily pass through the wellbore and any restrictions that may be encountered in the wellbore. Upon reaching the location, the stabilizer may be activated in order to extend a plurality of stabilizing members into engagement with an interior diameter of a tubular in the wellbore. The extension of the stabilizer members is accomplished by an actuator positioned along an axis which is offset from a radial dimension of the stabilizer, as will be described in more detail below. The stabilizer allows the downhole tool to rotate within the tubular while preventing the downhole tool from moving substantially radially in the tubular. Further, the arrangement of the actuators for the stabilizer members allow for compliant stabilization of the downhole tool. In other words, the stabilizing members may comply or retract at least partially when tubular inner diameter variations or restrictions are encountered. The stabilizing of the downhole tool allows the downhole tool to operate longer. Once the downhole operation is complete, the downhole tool and the stabilizer are removed from the wellbore and other downhole operations may be performed.

Figure 1:
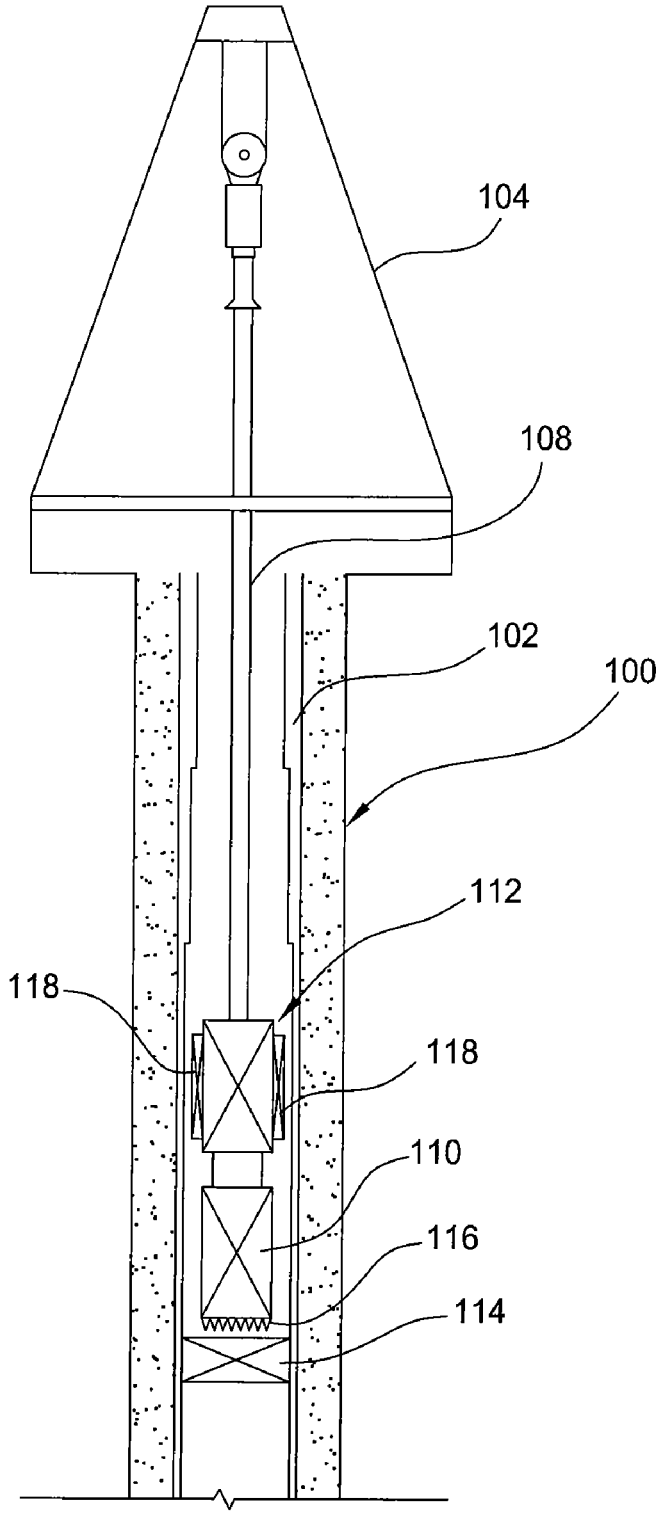
FIG. 1 is a schematic view of a wellbore and bottom hole assembly (BHA) according to one embodiment described herein.

FIG. 1 shows a schematic view of a wellbore 100 with a tubular 102 cemented in place, a drill rig 104, a conveyance 108, a downhole tool 110, shown as a milling tool, a stabilizer 112, and an item 114 stuck in the wellbore 100. The tubular 102, as shown, is a casing which has a tapered inner diameter. That is, the wall thickness of the casing near the surface of the earth is larger than the wall thickness of the casing lower in the wellbore, thereby creating a larger inner diameter of the tubular 102 at lower depths. Though shown having a tapered inner diameter, it should be appreciated that the tubular 102 may have any configuration including, but not limited to, a constant inner diameter, a larger inner diameter near the surface, or varying inner diameters. Although shown as the casing cemented into the wellbore 100, it should be appreciated that the casing may not be cemented in place or there may be no casing. Further, it should be appreciated that the tubular 102 may be any tubular for use in a wellbore including, but not limited to, a drill pipe, a production tubular, a liner, and a coiled tubing. Additionally, the invention may be used in an uncased or open portion of the wellbore 100. The conveyance 108 may be a drill string which may be rotated and axially translated from the drill rig 104; however, it should be appreciated that the conveyance could be any conveyance including, but not limited to, a co-rod, a wire line, a slick line, coiled tubing, and casing. The downhole tool 110 may be coupled to a drilling motor (not shown) in order to rotate the downhole tool 110 in a manner independent from the conveyance 108, or may be manipulated by the conveyance 108. The downhole tool 110 may be any downhole tool for use in a wellbore.

The lower end of the stabilizer 112 is shown connected to the downhole tool 110 and the upper end connected to the conveyance 108. Although the stabilizer is shown as a separate unit, it should be appreciated that the stabilizer may be integral with the downhole tool 110. The stabilizer 112, as will be described in more detail below, and the downhole tool 110 are lowered into the wellbore 100 until the downhole tool 110 engages the item 114 that is stuck in the wellbore. The item 114, as shown, is a packer which has been set in the tubular 102; however, the item 114 may be any item stuck in the wellbore 100 including, but not limited to, drill pipe, casing, production tubing, liner, centralizers, whipstocks, valves, drill bits, or drill shoes. Optionally, the item 114 may be cemented in place in the wellbore 100. Preferably, the downhole tool 110 engages the item 114 while the downhole tool 110 is rotating. In one embodiment, the downhole tool is a milling tool having a milling end 116 configured to mill away the item 114 and any cement attached to the item 114, while the stabilizer 112 substantially prevents vibration of the downhole tool 110. The downhole tool 110 is lowered while rotating and milling until the item 114 is no longer obstructing the wellbore 100.

The stabilizer 112 may include one or more stabilizing members 118, shown schematically in FIG. 1. As shown, the stabilizing members 118 are in the retracted or run in position. The retracted position is a position that allows the stabilizer 112 and the stabilizing members 118 to have an outer diameter that is less than the smallest inner diameter of the tubular 102. This allows the stabilizer 112 and the downhole tool 110 to run into the wellbore 100 without becoming stuck on the tubular 102 or another restriction in the tubular 102. When the downhole operation is to commence, or at any other desired time, the stabilizing members 118 may be activated. Upon activation, the stabilizing members 118 extend from the stabilizer 112 until they engage the inner diameter of the tubular 102. The stabilizer 112 and the stabilizing members 118 are arranged in a manner that allows the stabilizing members 118 to stabilize the downhole tool 110 while not expanding the tubular 102, as will be described in more detail below. During the stabilization process the stabilizing members 118 may retract or expand in compliance with the conditions on the inner diameter of the tubular 102. Thus, if the inner diameter of the tubular 102 increases as the downhole operation moves down the tubular 102, the stabilizing members will automatically extend to the new inner diameter of the tubular 102. Further, if the inner diameter of the tubular 102 decreases, or a restriction is encountered, the stabilizing members automatically retract or comply with the change.

Figure 2A:
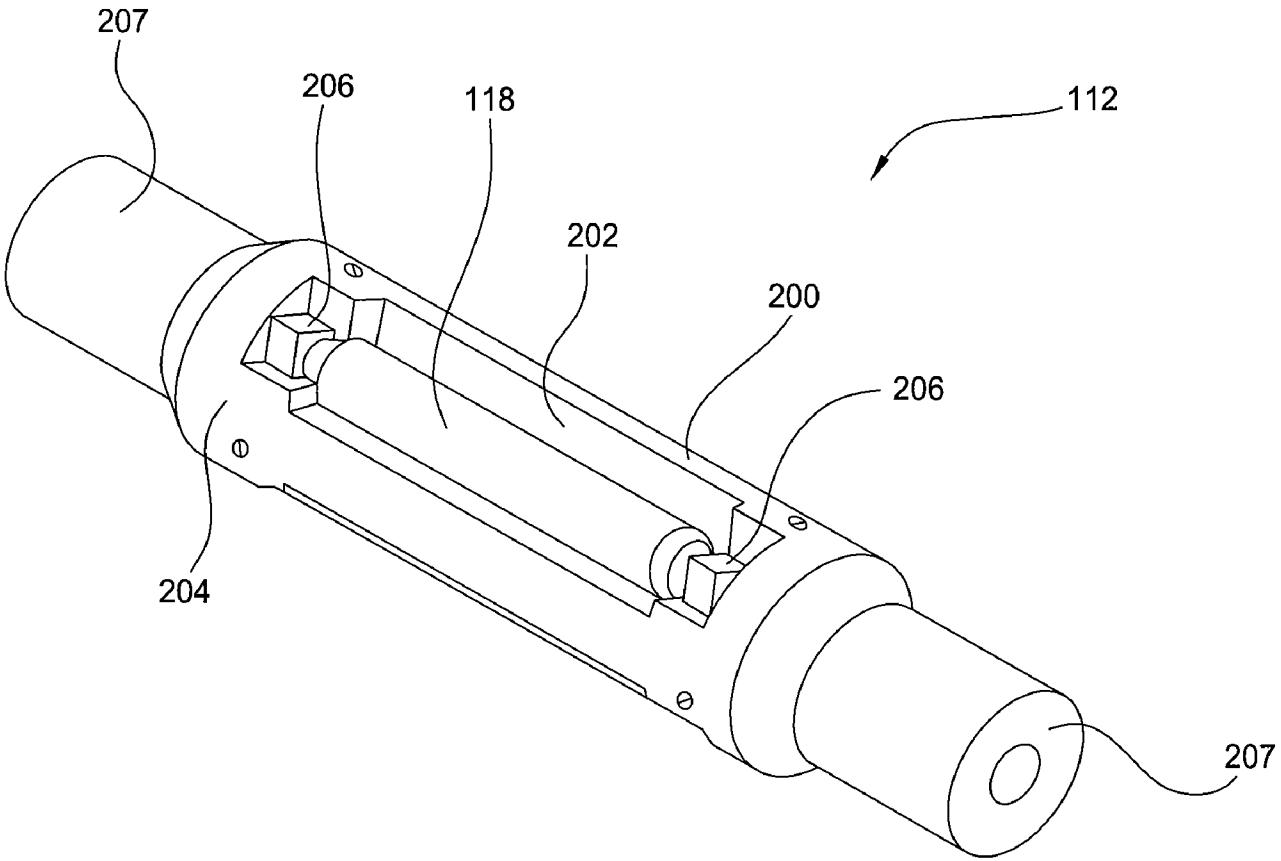
FIG. 2A is a perspective view of a stabilizer according to one embodiment described herein.

FIG. 2A shows a schematic view of the stabilizer 112 according to one embodiment described herein. The stabilizer 112 may have a body 200, one or more pockets 202, an enlarged diameter portion 204, one or more actuators 206, one or more stabilization members 118, and one or more connector ends 207. The connector ends 207 are adapted to couple the stabilizer 112 to the conveyance 108 and/or the downhole tool 110, or any other downhole member. The connector ends 207 may use any mechanism for connecting the stabilizer 112 to other downhole tool members, including but not limited to, a threaded connection, a welded connection, and a pinned connection.

Figure 2B:
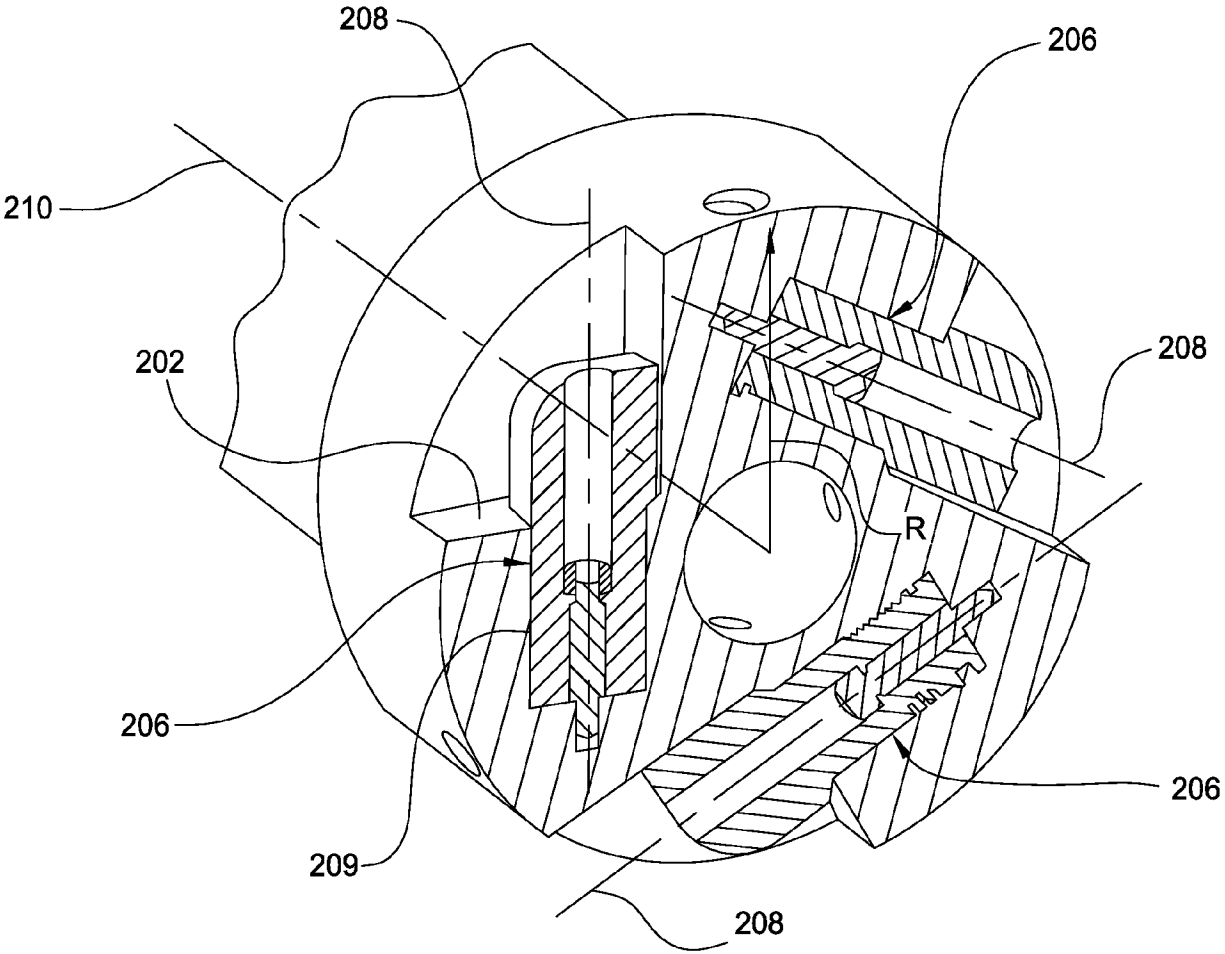
FIG. 2B is a cross sectional perspective view of a stabilizer according to one embodiment described herein.

The one or more pockets 202 formed in the body 200 may be adapted to house the stabilizing members 118 when in the retracted position. The one or more pockets 202 may be deep enough to include the entire stabilizing member 118 within the one or more pocket 202 when the stabilizing member 118 is in the retracted position. Thus, with the stabilizing members 118 are in the retracted position, the stabilizing members 118 would not extend past the outer diameter of the body 200. It should be appreciated that the one or more pockets may be at any depth. The one or more pockets 202 may further include a housing portion 209, as shown in FIG. 2B, adapted to house all or a portion of the one or more actuators 206. In an alternative embodiment, the one or more pockets only houses a portion of the one or more actuators 206. In this arrangement, the one or more stabilizing members 118 would always be entirely outside an outer diameter of the body 200.

The stabilization member 118, shown, is a roller adapted to extend from the body 200 of the stabilizer 112. The stabilizing members 118 may couple to the one or more actuators 206. The one or more actuators 206 are configured to move the stabilizing members 118 from the retracted position to the extended position. Although shown as a roller, it should be appreciated that the stabilization member 118 may be any member adapted to prevent vibration during a downhole operation including, but not limited to, a plurality of spheres, one or more pads, or any non rotating member.

FIG. 2B is a perspective cross-sectional view of the stabilizer 112 cut through the one or more actuators 206. The stabilizer 112 is shown with three actuators 206. Each actuator 206 has an actuation axis 208 which is the axis traveled by the stabilization members 118 when moving between the retracted position and the extended position. The actuation axis 208 is offset from the radius R of the body 200. In this aspect, the actuation axis 208 is always offset from, or at an angle to, any radius of the body 200 of the stabilizer 112. That is, the actuation axis 208 is not in line with any radius of the body 200. This offset provides the actuation axis 208 with a longer axis than a radius of the body. As a result of this offset, the stroke (e.g. distance) of the actuator 206 is greater compared to the stroke of an equivalent actuator extending radially from the center of the stabilizer 112. Therefore, the stabilization members 118 may extend out further to engage the interior of a tubular 102 due to this offset, or tangential, configuration, than stabilizer members extending substantially on a radial axis from the center of the body.

Figure 2C:
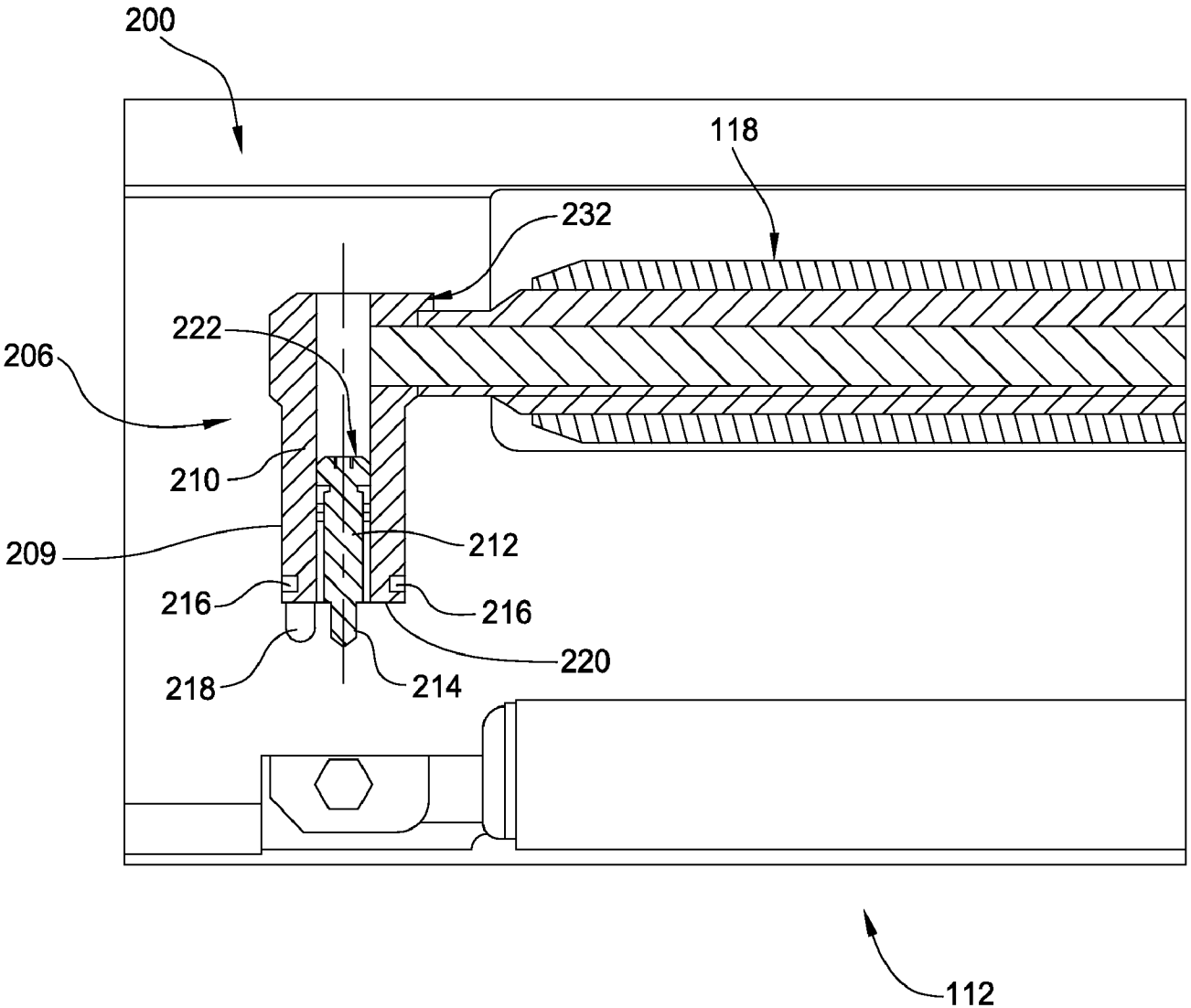
FIG. 2C is a cross sectional view of an actuator according to one embodiment described herein.

FIG. 2C shows a schematic cross sectional view of the actuator 206 located in the housing portion 209 and coupled to the stabilization member 118, according to one embodiment. The actuator 206 comprises an extendable member 210 and a stationary member 212. As shown, the extendable member 210 is in the form of a piston cylinder, and the stationary member 212 is in the form of a piston rod. It should be appreciated that the extendable member 210 may be any suitable extendable member including, but not limited to, a piston rod. Further, it should be appreciated that the stationary member 212 may be any member, including but not limited to, the housing portion 209 or a piston cylinder. The stationary member 212 may be coupled to the stabilizer 112 by a coupling member 214. The coupling member 214 may be of any type including, but not limited to, a threaded connection, a welded connection, a glued connection, or a collet type. In one embodiment, the extendable member 210 is positioned on each end of the stabilization member 118. In another embodiment, the extendable member 210 is positioned on one end of the stabilization member 118 and the other end is either fixed or allowed to move with the extendable member 210.

The extendable member 210 may include a one or more seals 216 configured to prevent fluid from flowing past the extendable member 210. A flow path 218 fluidly couples a piston surface 220 of the extendable member 210 to a communication path within the wellbore 100. The flow path 218 allows fluid to enter the housing portion 209 and exert a force on the piston surface 220. The force in turn extends the extendable member 210, and thereby the stabilization members 118 move the extended position. It should be noted that in one embodiment each stabilization member 118 includes the extendable member 210 on each end of the stabilization member 118. The piston surface 220 of each extendable member 210 has a surface area that is configured to allow the stabilization member 118 to move radially outward into engagement with the surrounding tubular (or wellbore) in order to stabilize the downhole tool. Additionally, the stabilization member 118 includes a surface area that is configured to provide a large contact area between the stabilization member 118 and the surrounding tubular (or wellbore). As such, the fluid pressure acting on the surface area of each piston surface 220 causes the stabilization member 118 to move radially outward such that the large contact area of the stabilization member 118 engages the surrounding tubular to stabilize the downhole tool while not expanding the tubular. In contrast, a fluid actuated expansion tool typically includes a large piston area and rotary members having a small contact area such that a large force is exerted on the small contact area with the surrounding tubular in order to expand the tubular.

In one embodiment, the communication path may be located in the interior of the stabilizer 112. Thus, fluid pressure in the conveyance 110 or the wellbore 100 may be increased to increase the fluid pressure within the stabilizer 112. The increased pressure in the stabilizer is communicated through the flow path 218 to the piston surface 220. The fluid may be hydraulic fluid or pneumatic fluid.

In an alternative embodiment, the communication path is located outside of the stabilizer 112. In this embodiment, the flow path would couple directly to the exterior of the stabilizer 112 and would be influenced by the fluid pressure in the annular area between the stabilizer 112 and the tubular 102.

The actuator 206 may include a throw limiter 222, which is shown as integral with the stationary member 212. The throw limiter 222 stops the extendable member 210 from extending beyond a predetermined extended position. When the extendable member 210 engages the throw limiter 222, the force applied to the piston surface 220 is mechanically transferred to another location on the stabilizer 112. In one embodiment, the force may be transferred to the coupling member 214. This feature enables the stabilizer 112 to be designed specifically for the tubular 102 in which the downhole operation is to be performed.

In an alternative embodiment, the extendable member 210 may be locked against the throw limiter 222 during a stabilization operation by a fluid or mechanical device. Locking the extendable member 210 against the throw limiter 222 keeps the extendable member 210 in the extended position during stabilization. When a variance or restriction is encountered within the wellbore, the extendable members 210 will remain against the throw limiter 222. A flexible member, as will be described in more detail below, may then allow the stabilization members 118 to retract and comply with the variance in the wellbore while the extendable members 210 are still engaged with the throw limiter 222. A fluid pressure higher than the force required to actuate the flexible member may be used in order to lock the extendable member to the throw limiter 222. Further, a mechanical lock (not shown), including but not limited to a pin or a collet, may be used to lock the extendable member 210 against the throw limiter 222.

In one embodiment, the stabilizer 112 includes one or more flexible members built into the system. The flexible member may be adapted to allow the stabilization members 118 to comply with any change in the inner diameter of the tubular or any restriction in the tubular during the stabilization process. That is, the stabilization members 118 will automatically comply to accommodate a restriction without the need to change the fluid actuation pressure in the actuator. The flexible member may be incorporated in the actuator 206, the stabilization member 118 or the coupling between the actuator 206 and the stabilization member 118.

Figure 2D:
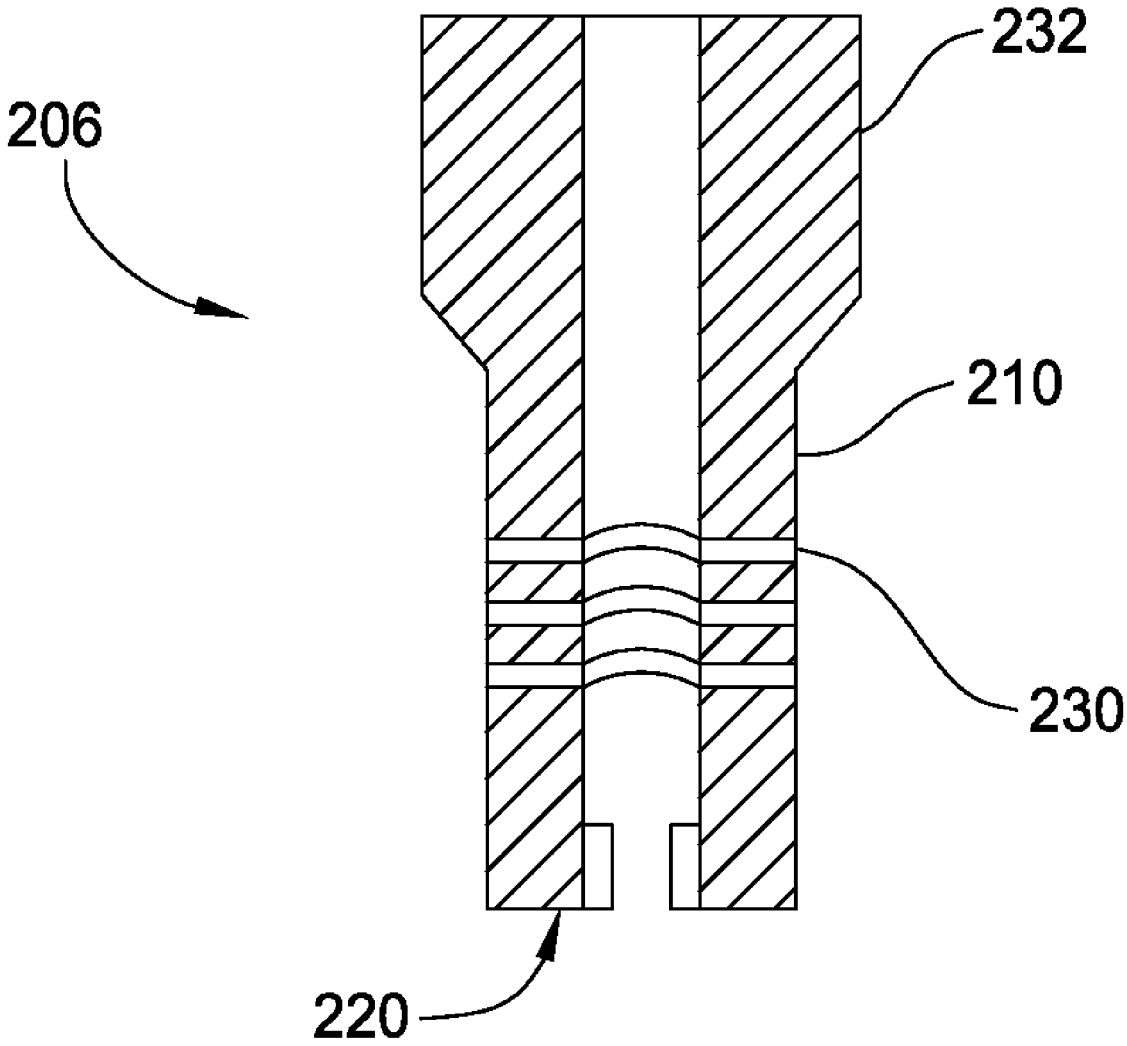
FIG. 2D is a cross sectional view of a portion of an actuator according to one embodiment described herein.

In one embodiment shown, the flexible member is one or more grooves 230 cut into the extendable member 210, as shown in FIG. 2D. The one or more grooves 230 may be formed in the extendable member 210 between the stabilization end 232 and the piston surface 220. The one or more grooves 230 enable the extendable member 210 to be substantially rigid under normal operating conditions. However, when large loads are applied to the stabilization member 118 and thereby to the stabilization end 232 of the actuator 206, the extendable member 210 will compress between the piston surface 220 and a stabilization end 232. Once the restriction has passed, the one or more grooves 230 will allow the extendable member to return to its original length. As shown, the one or more grooves 230 are one helical groove; however, it should be appreciated that the grooves may have any configuration, including but not limited to, multiple helical grooves, a series of lateral grooves, a series of transverse grooves, and/or multiple apertures. In yet another embodiment, the flexible member may be a portion of the extendable member 210 which is constructed of a flexible material such as a polymer, an elastomer, or a rubber. The flexible member may be integral with the actuator or be a separate member such as a spring.

A retraction member, not shown, may be included in the actuator 206. The retraction member may be configured to retract and/or bias the extendable member toward the retracted position. Thus, the stabilization members 118 will remain in the retracted position until an operator or controller initiates the stabilization process. This enables the stabilizer to run into the wellbore 100 without inadvertently extending the stabilization members 118. Thus, the stabilization members 118 are unlikely to encounter a restriction in the wellbore during the run in process.

Figure 3:
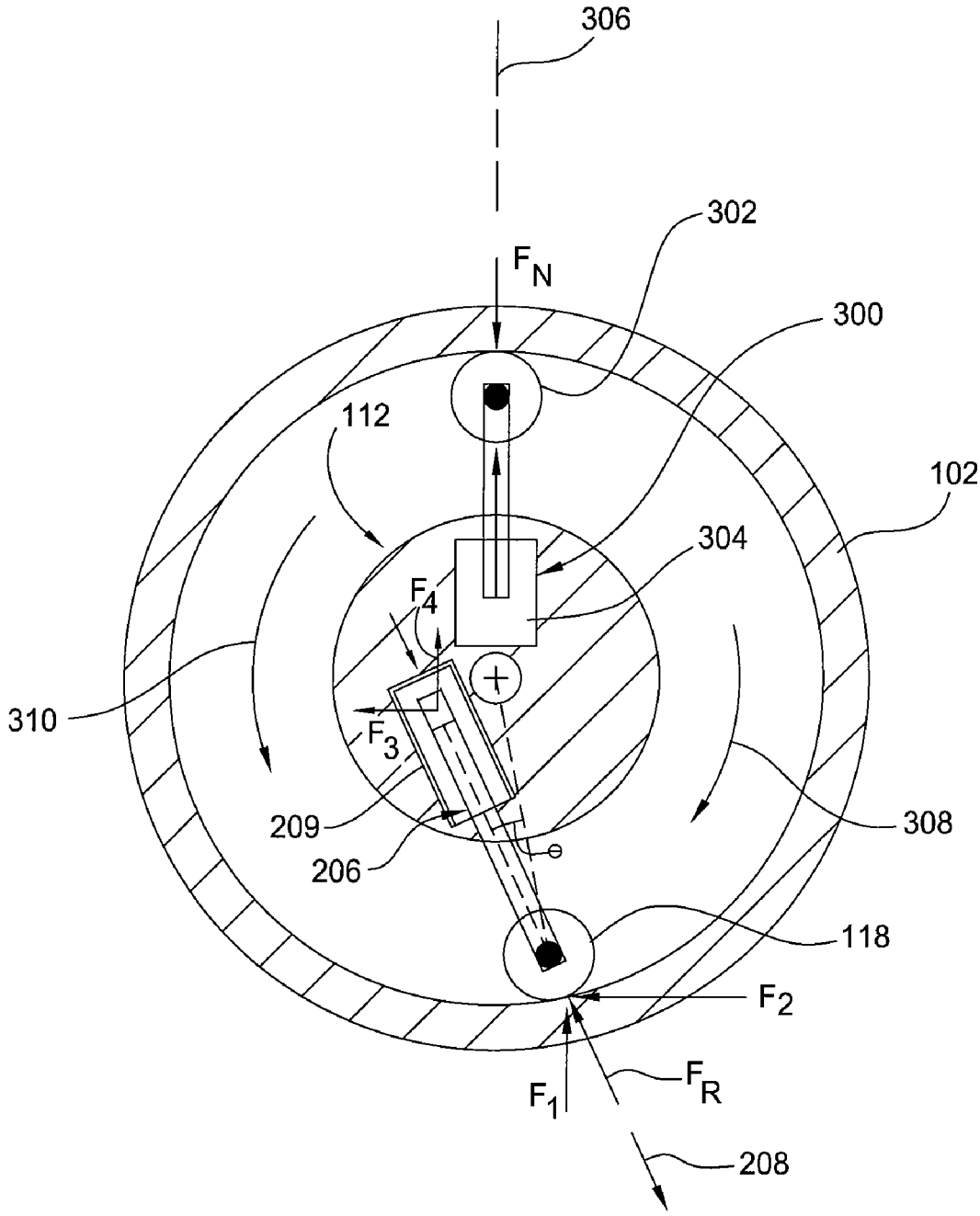
FIG. 3 is a cross sectional view of a tubular and a stabilizer according to one embodiment described herein.

The offset actuation axis 208 of the actuators 206 provides an increased mechanical advantage over a substantially radial actuated stabilizer. The offset actuation axis 208 decreases the amount of required actuator to stabilize when compared to a substantially radially actuated stabilizer. FIG. 3 shows a schematic cross sectional view of the stabilizer 112 having a stabilization member 118 having the offset actuation axis 208 and a radial stabilizer 300. The example radial stabilizer 300, as shown, has a radial stabilizing member 302, a radial actuator 304, and a radial axis 306; however, it should be appreciated that there may be any number of radial stabilizing members 302 and radial actuators 304. When actuated the radial stabilizer 300 creates a force Fn which is normal to the tubular 102 surface it encounters. That is, the full actuation force is encountered by the tubular in a direction radially from the interior of the tubular 102. Further, the rotation of the radial stabilizer 300 in either direction will not effect the loading of the tubular 102.

The offset actuation axis 208 allows the stabilization member 118 to engage the tubular 102 at an angle $\ominus$. A resultant force Fr caused by the stabilization members 118 is broken up into two effective forces F1, F2, acting on the tubular 102. Therefore, the load acting on the tubular 102 radially outward is reduced by a factor depending on the degree of the angle $\ominus$. Further, the direction of rotation of the downhole tool 110 and stabilizer 112 may play a factor in the amount of load transferred to the tubular 102 when using the offset actuation axis 208. Thus, rotation of the stabilizer 112 in a clockwise direction 308 will reduce the force F2 applied to the tubular 102 because the rotation is acting against the force F2. Further, rotation of the stabilizer 112 in a counterclockwise direction 310 will tend to increase the force F2 applied to the tubular 102 because the rotation is acting with the force F2. The offset actuation axis 208 allows a portion of a friction load created between the tubular and the stabilization members 118 to be absorbed along the axis. This makes the stabilizer 112 more resistant to tangential loads while stabilizing the downhole tool.

The angle $\ominus$ creates a pair of resultant forces acting on the housing portion 209 of the body 200. The force F3, as shown, will transfer load from a side of the actuator 206 to the housing portion 209. This side load F3 will help prevent the actuator 206 from retracting by creating a binding force that is normal to the actuation axis 208. Thus, if the same amount of pressure is applied to the stabilization members 118 as the radial stabilization members 302, the angle $\ominus$ will reduce the load applied to the tubular 102 and decrease the tendency for the actuator 206 to retract due to the normal force.

The offset actuation axis 208 also provides more space than the radial stabilization members 302. This is due to the greater distance from the stabilizer 112 end of the actuator 206 to the point of contact on the tubular 102 than the radial stabilizer 300. This allows for a greater range of application for any given size of tool thereby providing more flexibility in the design of the stabilizer 112. This allows for many improvements to the stabilizer including, but not limited to, a larger stabilization members 118, a longer piston stroke, and a larger flexible member or any combination thereof. The larger stabilization members 118 may be a roller having a larger diameter than the radial stabilization member 302. The larger roller also enables a longer life of the stabilization member 118 due to its increased robustness. Further, the loading on the tubular 102 created by the larger roller will be distributed over a wider area than the smaller radial stabilization member 302. Thus, the offset actuation axis 208 enables an increased roller diameter thereby extending the life of the stabilizer 112. The stabilizer 112 with larger diameter rollers and longer rollers lowers the contact stress on the tubular when compared to radial stabilizers. This lower contact stress further prevents unwanted expansion of the tubular.

Figure 4:
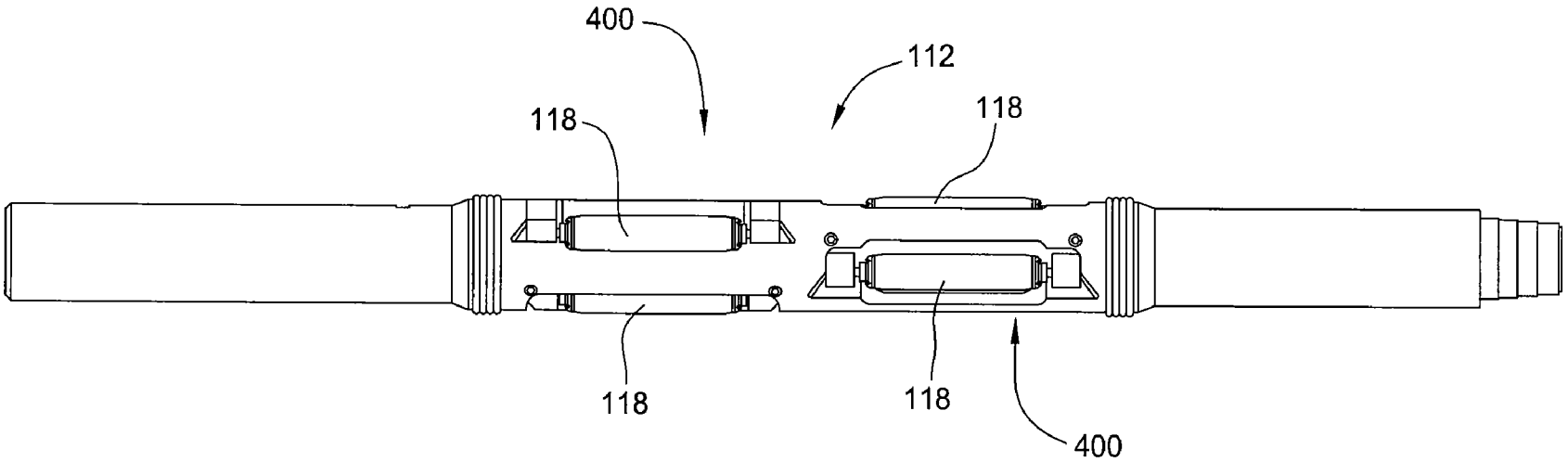
FIG. 4 is a view of a stabilizer according to one embodiment described herein.

In another embodiment, the stabilizer 112 includes multiple segments 400, as shown in FIG. 4. Each of the segments 400 includes a plurality of stabilization members 118. Any number of segments 400 may be used according to the requirements of the stabilization operation. The stabilization members 118 within each of the segments 400 may have any number of configurations around the circumference of the stabilizer 112. Further, the segments 400 may axially overlap one another.

Figure 5:
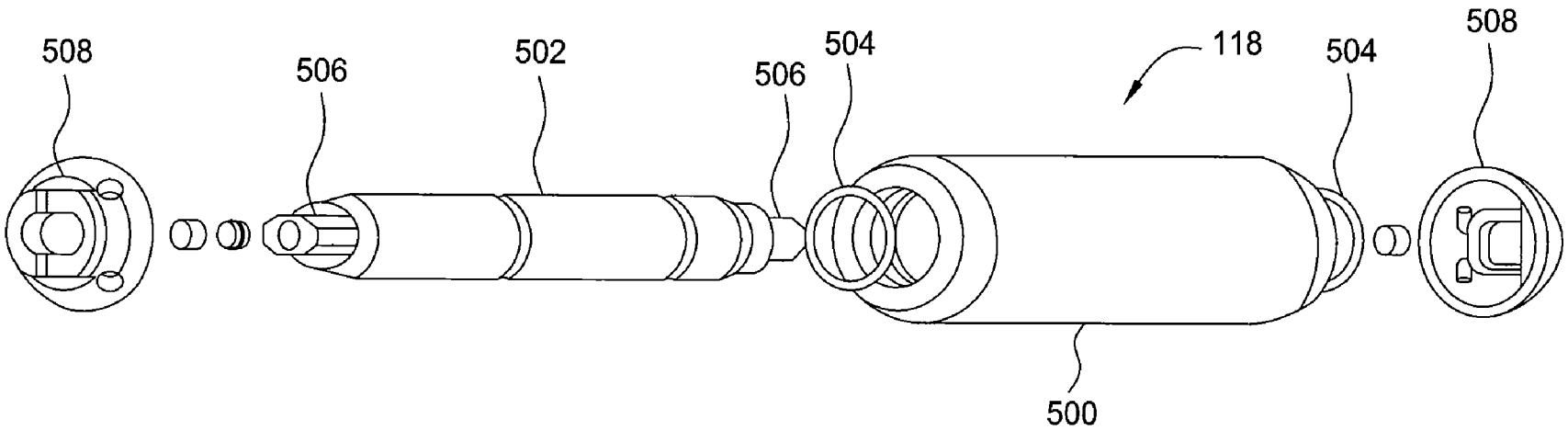
FIG. 5 is an exploded perspective view of a stabilization member according to one embodiment described herein.

FIG. 5, shows an exploded view of the stabilization member 118 which is shown as a roller 500. The roller 500 may include a roller pin 502 adapted to fit inside the roller 500. At the ends of the roller pin 502 are two seals 504 or o-rings adapted to hold a lubricant in the space between the roller pin 502 and the roller 500. The lubricant allows the roller 500 to rotate about the roller pin 502 with a minimal amount of friction between the two surfaces. The ends of the roller pin 502 may comprise a connector pin 506. The connector pin 506 may be adapted to mate with a bearing cap 508 at each end of the roller pin 502. With the bearing caps 508 coupled to the roller pin 502, the roller 500 may be substantially prevented from moving axially relative to the roller pin 502. The bearing caps 508 may act as a bearing which absorbs axial forces from the roller 500 during a stabilization operation. The bearing caps 508 and/or the connector pin 506 are adapted to couple directly to the actuators 206. Although shown as the stabilization members 118 being lubricated rollers 500, it should be appreciated that the rollers 500 may assume any form including, but not limited to, a solid roller member having pin ends coupled to the actuator 206 and/or a one piece design.

Figure 6A:
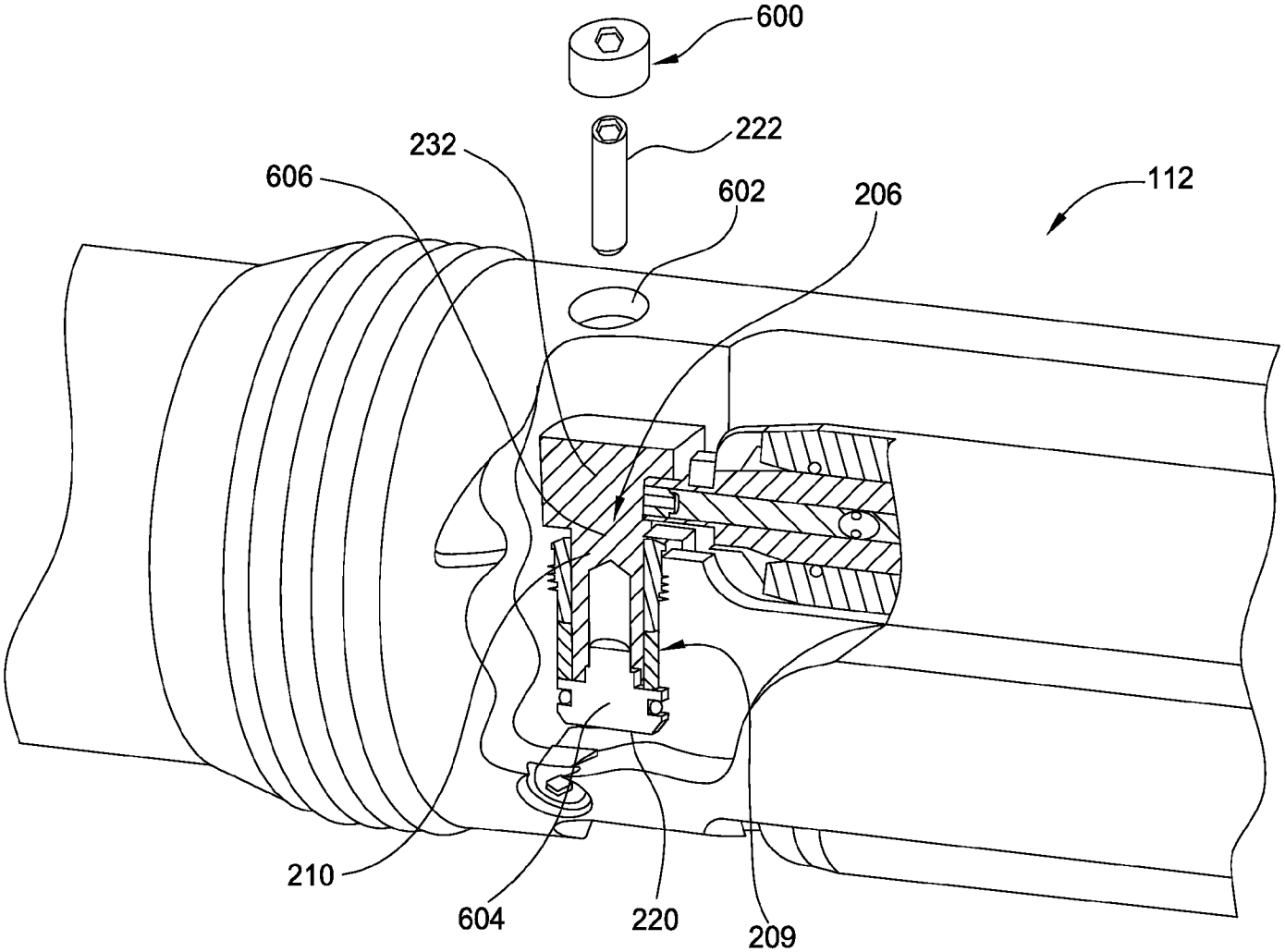
FIG. 6A is a perspective cross sectional view of a stabilizer according to one embodiment described herein.

In yet another alternative embodiment, the throw limiter 222 is externally mounted to the stabilizer 112, as shown in FIG. 6A. In this embodiment, the throw limiter couples directly to the outer portion of the stabilizer 112 and extends to a desired position. When the upper end of the extendable member 210 engages the throw limiter 222, the extendable member will be prevented from further movement in the extended direction. The throw limiter 222 in this embodiment may include a silt screen 600, shown schematically. The silt screen 600 prevents wellbore fluids and debris from engaging the actuator 206 from a hole 602 created to accommodate the throw limiter 222.

In yet another alternative embodiment, the stationary member is simply the housing portion 209 of the stabilizer 112, as shown in FIG. 6A. In this embodiment the extendable member 210 is fluidly sealed in the housing portion 209 and moves in response to fluid pressure applied to the piston surface 220 as described above. The extendable member 210 may include a piston member 604 and an actuator member 606. The piston member 604 is adapted to sealing engage the housing portion 209 and thereby reacts to the force created by the fluid pressure, as described above. The piston member 604 moves in response to the fluid pressure or a biasing force in order to move the actuator member 606. The actuator member 606 moves the stabilization member 118. The actuator member 606 may include any of the flexible members described above.

Figure 6B:
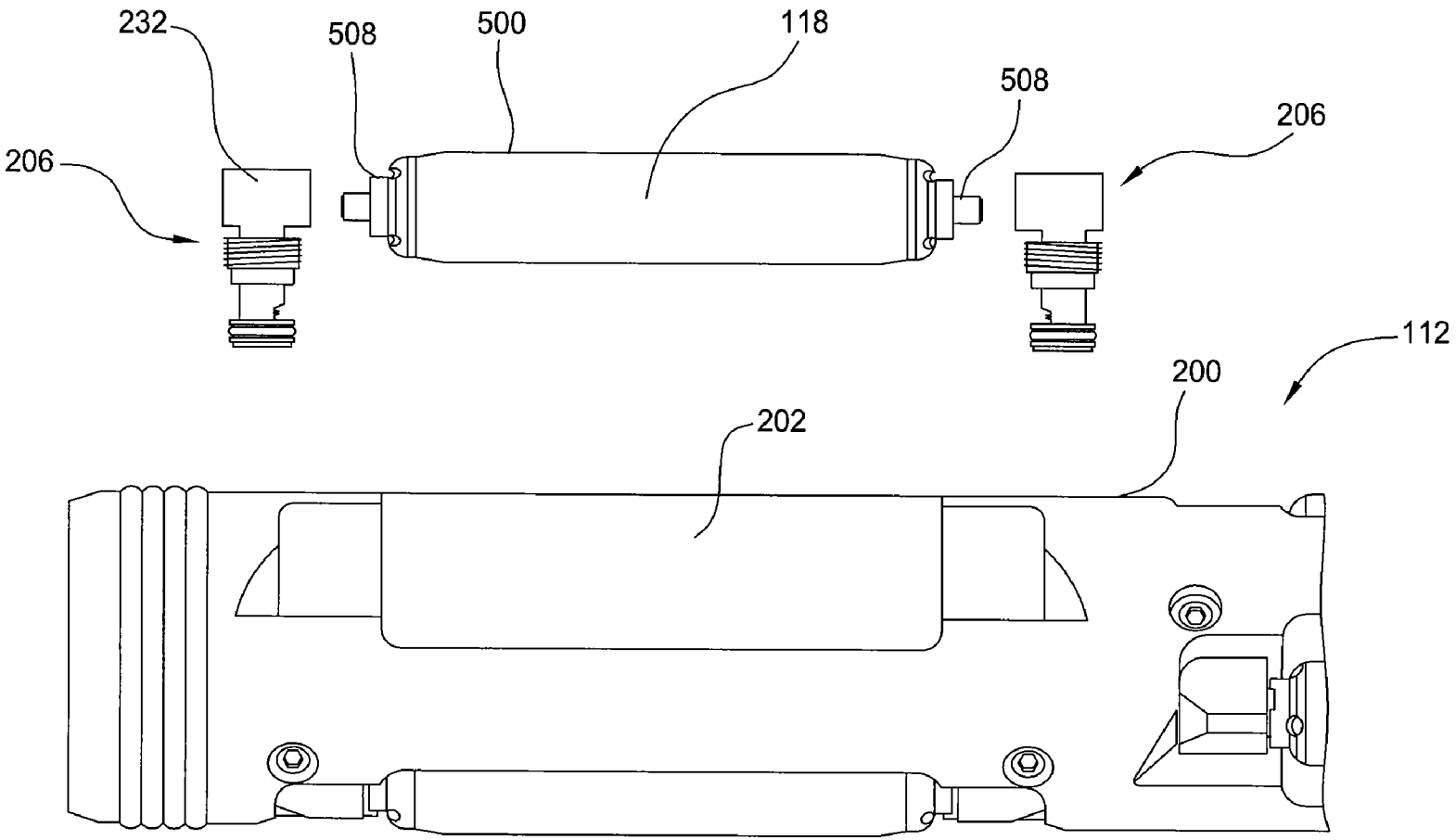
FIG. 6B is an exploded view of a stabilizer according to one embodiment described herein.

FIG. 6B shows an exploded schematic view of the stabilization member 118, the actuators 206, the body 200 of the stabilizer 112, and the pockets 202. The stabilization member 118 may be the roller 500 having the bearing caps 508. The bearing caps 508 are adapted to engage the stabilization end 232 of the actuator 206. The engagement between the stabilization end 232 and the bearing caps 508 may be accomplished using any method including, but not limited to, a pin, a screw, a form, or press fitting. The actuators 206 couple to the stabilizer 112 with the roller 500 engaged between the actuators 206. With the actuators 206 coupled to the roller bearing caps 508, the roller 500 is free to rotate about its own longitudinal axis while being prevented from movement in the axial direction.

Figure 7:
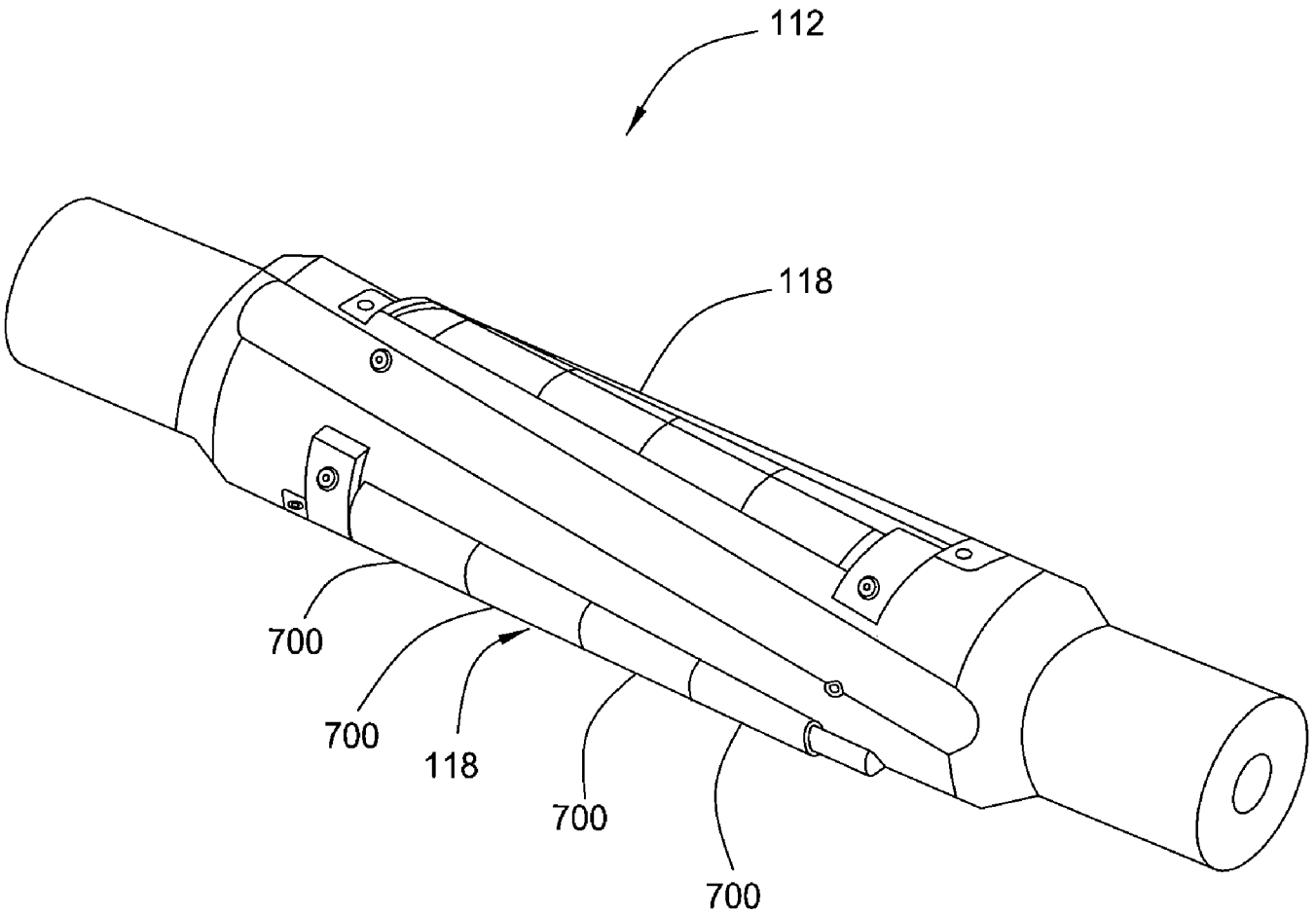
FIG. 7 is a perspective view of a stabilizer according to one embodiment described herein.

In yet another embodiment, the stabilization members 118 are helically arranged around the outer diameter of the stabilizer 112, as shown in FIG. 7. This arrangement may require a plurality of independent rollers 700 within each of the stabilization members 118. This allows the independent rollers 700 of the stabilization member 118 to rotate at different speeds during stabilization. The helically arranged stabilization members 118 may allow for 360° roller contact around the interior of the tubular during stabilization. The helically arranged stabilization members may be configured to produce a tractor effect. Thus, as the stabilization members 118 rotate, the helically arrangement pulls the stabilizer down or up hole. This feature allows the stabilizer 112 to drive the downhole tool in the wellbore. In a deviated or horizontal wellbore the drive feature of the helically arranged stabilizers may assist in controlling and/or enabling applied weight to the downhole tool.

In yet another embodiment, the extendable member 210 is a rod type member, not shown. In this embodiment, the flexible member is incorporated or coupled to the rod. The flexible member may be a spring which is integral with the rod between the piston surface and the stabilization end of the rod. Further, the rod may be partially constructed of a flexible material such as a polymer, an elastomer, or a rubber.

In yet another embodiment, the flexible member is located between the actuator 206 and the body 200. In this embodiment the flexible member may be a spring or other flexible member located between the actuator 206 and the housing portion 209. Further, a flexible arm, not shown, may be used to couple the actuator 206 to the stabilizer 112, thereby allowing for a predetermined amount of flexibility between the actuator and the stabilizer 112.

Figure 8A:
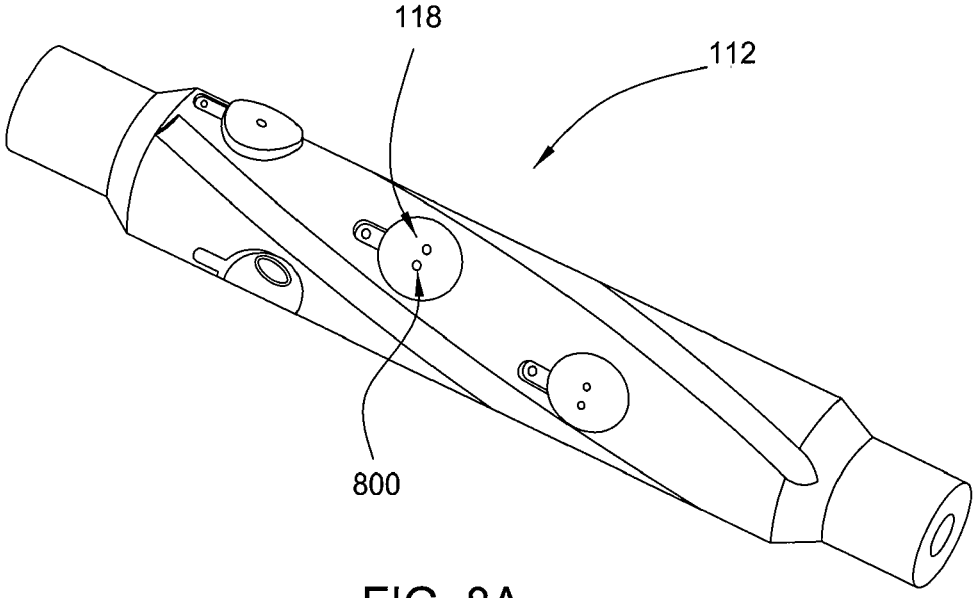
FIG. 8A is a perspective view of a stabilizer according to one embodiment described herein.
Figure 8B:
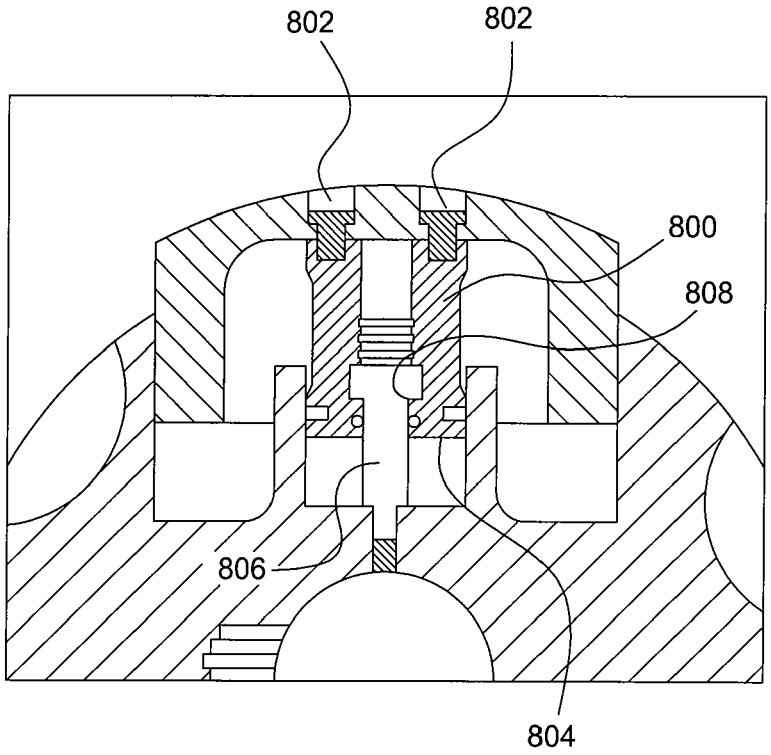
FIG. 8B is a cross sectional view of a stabilization member according to one embodiment described herein.

In yet another embodiment, the each stabilization member 118 is simply an extendable member 800, as shown in FIGS. 8A and 8B. The extendable member has one or more pads 802 adapted to engage the inner diameter of the tubular 102. The extendable member 800 may include a piston surface 804, a stationary member 806, a throw limiter 808, and a retraction member similar to those described above. Further, the extendable member 800 may include a flexible member such as described above.

In yet another embodiment, the extendable member may include multiple pieces which move relative to one another in a telescopic manner, not shown. This allows the extendable member to extend further than a solid extendable member.

The stabilizer 112 may be designed to travel through a relatively small restriction in the tubular 102 then extend to engage the tubular 102. For example, the item 114 may be a packer stuck in the tubular 102 below a sting of production tubing. The production tubing may have a much smaller internal diameter than the tubular 102, which may be a casing. The downhole tool 110, the stabilizer 112, and the conveyance 108 may be run through the production tubing until they are outside of the lower end of the production tubing. The downhole tool 110 may continue until it is proximate to the item 114. Once near the item 114, the stabilizer 112 is activated and the stabilization members 118 are moved from the retracted position to the extended position in which the stabilization member 118 engages the inner diameter of the tubular 102. The downhole operation may then be performed.

In operation, the downhole tool 110 is coupled to the stabilizer 112 and the two are run into the wellbore 100. Initially the stabilizer 112 is in the retracted position thereby allowing the stabilizer to easily pass through the tubular 102. Once the downhole and/or stabilizing operation is to begin, fluid pressure may be increased within the stabilizer 112. The fluid pressure may be increased by flowing fluid through a nozzle of the downhole tool or by any other method. The fluid pressure causes fluid to flow into the flow path 218 and to exert a force on the piston surface 220. The force on the piston surface 609 may have to overcome a retraction force from the retraction member. Once the force is large enough to move the extendable member 210, the stabilization members 118 begin to move along an axis that is at an angle to any radius of the stabilizer. The stabilization members 118 move toward the extended position until the stabilization members 118 engage the inner diameter of the tubular 102 and/or the throw limiter 222. The stabilizer 112 may be rotated during extension or after extension of the stabilization members 118. The rotation of the stabilizer 112 may cause the stabilization members 118 to roll if they are rollers. This enables the stabilizer to rotate freely about its own axis with minimal resistance from the stabilization members. The stabilizer 112 in this position prevents the downhole tool 110 from vibrating during the downhole operation of the stuck item 114.

As the downhole operation continues, an excessive load may be applied to the stabilization members 118. This load may be created by a restriction in the tubular 102, a smaller inner diameter in the tubular 102, or an inadvertent spike in fluid pressure acting on the extendable member 210. When the excessive load is encountered, a flexible member within the stabilizer 112 allows the stabilization members 118 to move toward the retracted position or allows the extendable member 210 to compress. This decreases the load applied between the stabilization members 118 and the tubular 102. Thus, the stabilization members 118 will not inadvertently deform the tubular 102.

While the foregoing is directed to embodiments of the present invention, other and further embodiments of the invention may be devised without departing from the basic scope thereof, and the scope thereof is determined by the claims that follow.

The invention claimed is:

1. A method of stabilizing a downhole tool in a wellbore during a downhole operation, the method comprising:

coupling a stabilizing tool to the downhole tool, the stabilizing tool having a plurality of stabilization members;

running the downhole tool and the stabilizing tool into the wellbore;

applying a fluid pressure to the stabilization members to extend the stabilization members radially outward to engage a surface of the wellbore, wherein the stabilization members are extended along an actuation axis which does not intersect a central axis of the stabilizing tool and along a transverse plane relative to the central axis of the stabilizing tool; and retracting the stabilization members while applying the fluid pressure.

2. The method of claim 1, further comprising rotating the stabilizing tool while engaging the surface with the stabilization members.

3. The method of claim 1, further comprising compliantly retracting the stabilization members upon encountering a restriction in the wellbore.

4. The method of claim 1, further comprising limiting the radial outward movement of the stabilization member by utilizing a mechanical stop.

5. The method of claim 1, wherein the surface is an inner diameter of a tubular.

6. The method of claim 1, wherein the stabilization member comprises a bearing pad.

7. The method of claim 1, wherein the stabilization member comprises a bearing roller.

8. The method of claim 1, wherein the fluid pressure is applied to a first piston area and a second piston area on each stabilization member.

9. An apparatus for stabilizing a downhole operation in a wellbore, comprising:

a tubular body;

a stabilization member operatively coupled to the tubular body and configured to engage a surface in the wellbore;

a fluid operated actuator at least partially contained within the tubular body and configured to move the stabilization member between a retracted position and an extended position along a non-radial axis of the tubular body; and a flexible member disposed between the stabilization member and the tubular body, wherein the flexible member is configured to absorb load variations in the wellbore while fluid pressure operating the actuator is maintained.

10. The apparatus of claim 9, wherein the flexible member comprises one or more grooves formed in the actuator.

11. The apparatus of claim 9, wherein the flexible member comprises one or more springs.

12. The apparatus of claim 9, further comprising a mechanical stop configured to define the location of the extended position.

13. The apparatus of claim 9, wherein the surface is an inner diameter of a tubular.

14. The apparatus of claim 9, wherein the stabilization member comprises a bearing pad.

15. The apparatus of claim 9, wherein the stabilization member comprises a bearing roller.

16. The apparatus of claim 9, wherein the fluid operated actuator includes a piston area.

17. The apparatus of claim 16, further comprising a second fluid operated actuator having a piston area.

18. The apparatus of claim 9, wherein the stabilization member is extended along a transverse plane relative to the central axis of the stabilizing tool.

19. The apparatus of claim 9, wherein the non-radial axis includes an axis that does not intersect a central longitudinal axis of the tubular body.

20. The apparatus of claim 9, further comprising a mechanical stop for engagement with the actuator to prevent movement of the stabilization member beyond the extended position, wherein the flexible member is configured to allow retraction of the stabilization member from the extended position while the actuator engages the mechanical stop.

21. The apparatus of claim 9, wherein the flexible member is formed from a material that is different than a material of the actuator.

22. The apparatus of claim 9, further comprising a plurality of stabilization members disposed about the circumference of the tubular body, and a plurality of fluid operated actuators configured to move the plurality of stabilization members between retracted and extended positions along non-radial axes that do not intersect a central longitudinal axis of the tubular body.

23. The apparatus of claim 9, wherein the stabilization member comprises a roller member, wherein the fluid operated actuator includes a first extendible member coupled to a first end of the roller member, and further comprising a second fluid operated actuator including a second extendible member coupled to a second end of the roller member, wherein the first and second extendible members are movable using fluid pressure to move the roller member to the extended position.

24. The apparatus of claim 23, wherein the roller member is coupled to the first and second extendible members so that it is rotatable relative to the tubular body.

25. The apparatus of claim 23, wherein the fluid operated actuator includes a first stationary member coupled to the first extendible member and the tubular body, and wherein the second fluid operated actuator includes a second stationary member coupled to the second extendible member and the tubular body.

26. The apparatus of claim 25, wherein the first and second extendible members are piston cylinders, and wherein the first and second stationary members are piston rods.

27. An apparatus for stabilizing a downhole tool, comprising:

a tubular body having a plurality of pockets formed therein;

a plurality of stabilization members disposed in the plurality of pockets, wherein the stabilization members are configured to engage a wall of a wellbore by moving from a retracted position to an extended position;

a fluid operated actuator configured to move each stabilization member between the retracted position and the extended position along an axis which is offset from a radius of the tubular body; and a bias member disposed between each stabilization member and the tubular body, the bias member is configured to allow each stabilization member to move radially in response to variations in the wall of the wellbore while in the extended position.

28. The apparatus of claim 27, further comprising a second fluid actuator, wherein each fluid actuator includes a piston surface.

29. The apparatus of claim 27, wherein the pockets are helically arranged around tubular body.

30. The apparatus of claim 27, wherein the axis does not intersect a central longitudinal axis of the tubular body.

31. The apparatus of claim 27, further comprising a mechanical stop for engagement with each actuator to prevent movement of the stabilization member beyond the extended position, wherein the bias member is configured to allow retraction of the stabilization member from the extended position while the actuator engages the mechanical stop.

32. The apparatus of claim 27, wherein the bias member is formed from a material that is different than a material of the actuator.

33. The apparatus of claim 27, wherein the plurality of stabilization members comprise roller members, wherein each fluid operated actuator includes a first extendible member coupled to a first end of the roller members, and further comprising a plurality of second fluid operated actuators, each including a second extendible member coupled to a second end of the roller members, wherein the first and second extendible members are movable using fluid pressure to move the roller members to the extended position.

34. The apparatus of claim 33, wherein the roller members are coupled to the first and second extendible members so that they are rotatable relative to the tubular body.

35. The apparatus of claim 33, wherein each fluid operated actuator includes a first stationary member coupled to the first extendible member and the tubular body, and wherein each second fluid operated actuator includes a second stationary member coupled to the second extendible member and the tubular body.

36. The apparatus of claim 35, wherein the first and second extendible members are piston cylinders, and wherein the first and second stationary members are piston rods.

* * * * *